US010057687B2

(12) United States Patent
Guo et al.

(10) Patent No.: US 10,057,687 B2
(45) Date of Patent: Aug. 21, 2018

(54) SPEAKER STRUCTURE

(71) Applicant: Goertek, Inc., Shandong (CN)

(72) Inventors: Xiang Guo, Shandong (CN); Chengfei Zhang, Shandong (CN)

(73) Assignee: Goertek, Inc., Shandong (CN)

( * ) Notice: Subject to any disclaimer, the term of this patent is extended or adjusted under 35 U.S.C. 154(b) by 0 days.

(21) Appl. No.: 15/528,614

(22) PCT Filed: Nov. 16, 2015

(86) PCT No.: PCT/CN2015/094733
§ 371 (c)(1),
(2) Date: May 22, 2017

(87) PCT Pub. No.: WO2016/078561
PCT Pub. Date: May 26, 2016

(65) Prior Publication Data

US 2017/0265007 A1 Sep. 14, 2017

(30) Foreign Application Priority Data

Nov. 20, 2014 (CN) ..... 2014 1 0670050

(51) Int. Cl.
*H04R 9/06* (2006.01)
*H04R 9/02* (2006.01)
(Continued)

(52) U.S. Cl.
CPC ..... *H04R 9/06* (2013.01); *H04R 7/127* (2013.01); *H04R 9/025* (2013.01); *H01F 7/0289* (2013.01); *H04R 2400/11* (2013.01)

(58) Field of Classification Search
CPC ..... H04R 9/06; H04R 9/025; H04R 7/127; H04R 2400/11; H01R 7/0289
(Continued)

(56) References Cited

U.S. PATENT DOCUMENTS 7,447,327 B2 * 11/2008 Kitamura ..... H04R 1/06 381/409
8,774,448 B2 * 7/2014 Li ..... H04R 9/025 381/398
(Continued)

FOREIGN PATENT DOCUMENTS

CN 2229124 Y 6/1996
CN 201854411 * 6/2008 ..... H04R 9/06
(Continued)

OTHER PUBLICATIONS

English translation of International Search Report and Written Opinion for PCT/CN2015/094733 dated Jan. 11, 2016 (7 pages).
(Continued)

*Primary Examiner* — Oyesola C Ojo
(74) *Attorney, Agent, or Firm* — Patent Law Works LLP

(57) ABSTRACT

The present invention provides a speaker structure, comprising a vibrating component, an electromagnetic component, an casing and an integral washer conductive sheet. The electromagnetic component comprises a central magnet and peripheral magnets which are disposed around the central magnet. The integral washer conductive sheet replaces a washer structure and an conductive sheet structure in a traditional speaker structure and is integrally formed by the washer and an conductive sheet which are combined into one part. The integral washer conductive sheet comprises a washer part and an conductive sheet part, wherein the washer part is disposed on the peripheral magnets and the conductive sheet part extends out of the casing. By adopting the integral washer conductive sheet according to the present invention, those skilled in the art can simplify an internal structure of the speaker, save production materials, simplify molding and assembling procedures, and improve production efficiency.

10 Claims, 4 Drawing Sheets

(51) Int. Cl.
*H04R 7/12* (2006.01)
*H01F 7/02* (2006.01)

(58) Field of Classification Search
USPC ..... 381/394, 398, 403, 410
See application file for complete search history.

(56) References Cited

U.S. PATENT DOCUMENTS

| | | | | | |
|---|---|---|---|---|---|
| 9,473,837 | B2 * | 10/2016 | Choi | ..... | H04R 9/025 |
| 2004/0008861 | A1 * | 1/2004 | Lu | ..... | H04R 9/025<br>381/412 |
| 2006/0171554 | A1 * | 8/2006 | Kajiwara | ..... | H04R 9/06<br>381/396 |
| 2011/0075880 | A1 * | 3/2011 | Kamimura | ..... | H04R 1/06<br>381/413 |

FOREIGN PATENT DOCUMENTS

| | | | | | |
|---|---|---|---|---|---|
| CN | 201854411 | U | | 6/2011 | |
| CN | 104144373 | | * | 6/2014 | ..... H04R 9/06 |
| CN | 203722813 | | | 7/2014 | |
| CN | 203912178 | | | 10/2014 | |
| CN | 203912189 | | | 10/2014 | |
| CN | 104144373 | A | | 11/2014 | |
| CN | 104320747 | | | 1/2015 | |
| CN | 204180269 | U | | 2/2015 | |
| JP | 2001320797 | | * | 11/2001 | ..... H04R 9/04 |
| JP | 3957443 | B2 | | 5/2007 | |
| JP | 2008148096 | | * | 6/2008 | ..... H04R 9/04 |
| JP | 2012182773 | A | | 9/2012 | |

OTHER PUBLICATIONS

Chinese Office Action dated Feb. 27, 2017, Chinese Application No. 201410670050.0 with English translation of the text (13 pages).

* cited by examiner

SPEAKER STRUCTURE

TECHNICAL FIELD

The present invention belongs to the technical field of acoustoelectric transduction, and particularly relates to a structural design of a washer and an conductive sheet in a speaker and a speaker structure.

BACKGROUND

In the field of modern acoustoelectric technology, speakers are important transduction devices, and are common in electronic devices such as various communication devices, and audio-visual equipment. A uniform magnetic field is formed in a speaker, and a voice coil made of a conductive material is suspended in the uniform magnetic field of the speaker. Due to the function of Lorentz force, when a signal carrying a sound characteristic in the voice coil is changed, the voice coil will vibrate, such that a vibrating diaphragm is driven to make a sound, and an electric signal is converted into a sound.

However, it is difficult to realize the uniform magnetic field in an actual environment. In order to enhance a sound quality of the speaker, those skilled in the art usually dispose a washer around a magnet of the speaker to correct magnetic lines, so as to form a magnetic field with a larger range and uniform magnetic lines as much as possible.

However, as shown in FIG. 1, a washer 01 needs to be independently mounted in the speaker and occupies certain space, which increases complexity of a speaker structure and adds extra steps in machining and assembling processes. 02 in FIG. 1 is an conductive sheet, and is configured to guide an external signal into the speaker. In order to optimize an internal structure of the speaker and simplify machining procedures of parts, it is necessary to provide a simpler solution.

SUMMARY

In order to solve the above technical problem, the present invention provides a speaker structure, comprising a vibrating component;

an electromagnetic component, comprising a central magnet and peripheral magnets which are disposed around the central magnet;

a casing bearing speaker parts;

an integral washer conductive sheet, comprising a washer part for correcting magnetic lines and an conductive sheet part for conducting a signal, wherein the washer part and the conductive sheet part are integrally formed, the washer part is disposed on the peripheral magnets and the conductive sheet part extends out of the casing; and an insulating material, disposed between the integral washer conductive sheet and the peripheral magnets.

The washer part can cover part of the peripheral magnets, and the peripheral magnets not covered by the washer part are covered by peripheral washers. Particularly, the peripheral washers comprise long axis washers and short axis washers, which are disposed on the peripheral magnets of different lengths respectively. The washer part can be a strip structure, and the speaker structure comprises two integral washer conductive sheets disposed on the peripheral magnets with different lengths and different locations around the central magnet.

The washer part can be an annular washer part covering all the peripheral magnets, and the integral conductive sheet comprises two conductive sheet parts extending outwards from the washer part.

The integral washer conductive sheet is made of a permeability magnetic material. Particularly, the integral washer conductive sheets can be fixedly coupled with the casing.

The vibrating component further comprises: a vibrating diaphragm mounted on the casing and a voice coil suspended on the casing, the voice coil comprising a lead and a vibrating ring. The lead is electrically connected to the conductive sheet part, and the voice coil drives the vibrating diaphragm to vibrate. The vibrating diaphragm is provided with a composite layer Dome.

The electromagnetic component further comprises a central washer disposed on the central magnet and a basin frame mounted at the bottom of the casing.

According to the speaker structure provided by the present invention, a washer structure and an conductive sheet structure in a traditional structure are combined together and are integrally manufactured, and the number of parts in the speaker is reduced. Such combination effectively reduces complexity in a manufacturing process and assembling process of the speaker structure, reduces a material cost, meets the demands in actual production and improves the efficiency in product machining.

DETAILED DESCRIPTION

Figure 1:
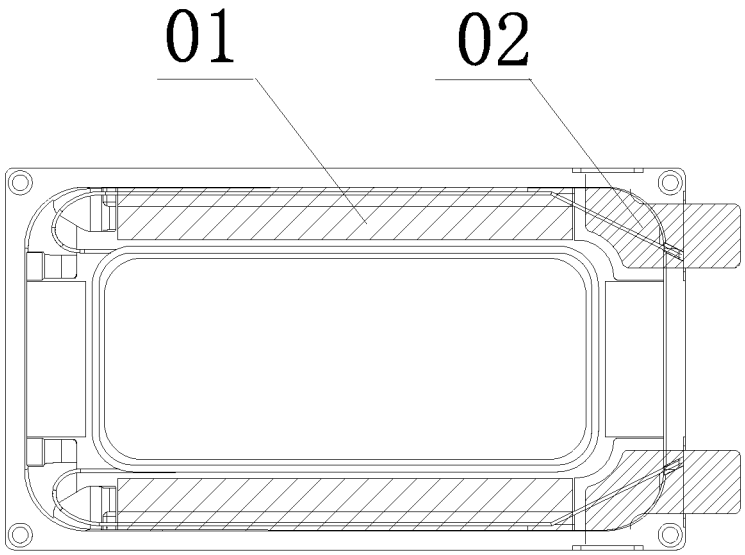
FIG. 1 is a top view of a speaker structure in the prior art, where part of components are removed.

Embodiments of the present invention will be described in detail, and examples of the embodiments are illustrated in the accompanying drawings, wherein, the same or similar reference numerals represent the same or similar components or components with the same or similar functions from beginning to end. The embodiments described with reference to the accompanying drawings are exemplary and merely used for explaining the present invention rather than limiting the present invention.

Figure 2:
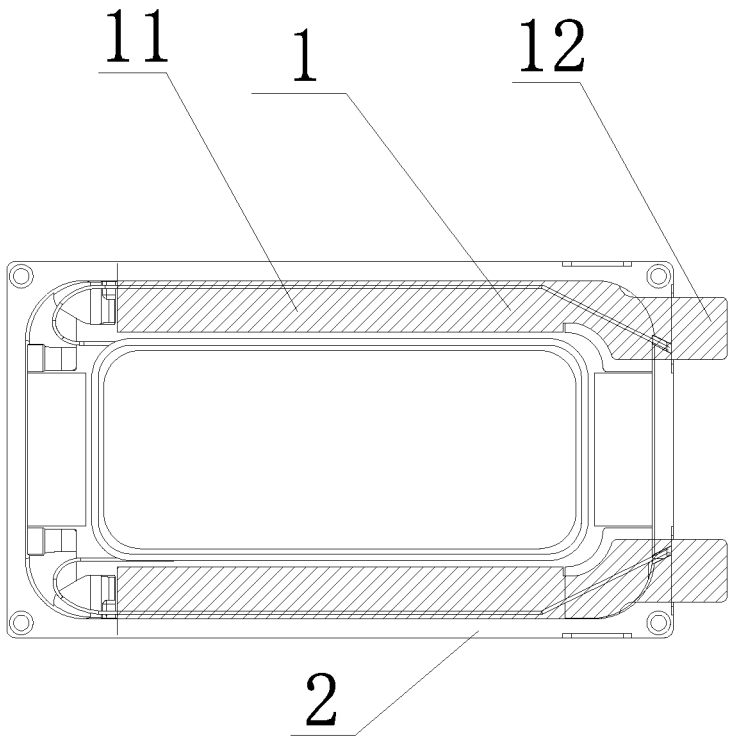
FIG. 2 is a top view of a speaker structure provided by a specific embodiment of the present invention, where part of components are removed.

The present invention provides a simplified speaker structure, comprising a vibrating component, an electromagnetic component, an integral washer elastic and an casing bearing respective components. The electromagnetic component comprises a central magnet and peripheral magnets which are disposed around the central magnet. The integral washer is disposed on the peripheral magnets, and comprises a washer part 11 for correcting magnetic lines and an conductive sheet part 12 for conducting a signal, wherein the conductive sheet part 12 extends out from the casing 2. The conductive sheet part 12 plays a role in conducting a signal in the speaker structure, an external sound signal is transmitted into the speaker through the conductive sheet, and the vibrating component vibrates and makes a sound according to signal features. An insulating material is disposed between the integral washer conductive sheet and the peripheral magnets and prevents the washer part from affecting performances of the peripheral magnets after the signal is conducted. The insulating material may be high temperature-resistance insulating adhesive tape or insulating glue. As shown in FIG. 2, the integral washer conductive sheet 1 is of an integral structure, the present invention combines a washer 01 and an conductive sheet 02 of the speaker in FIG. 1 into one part, which reduces complexity in machining and assembling. The electromagnetic component also comprises a central washer disposed on the central magnet and the central washer may correct a magnetic field generated by the magnet.

Figure 3:
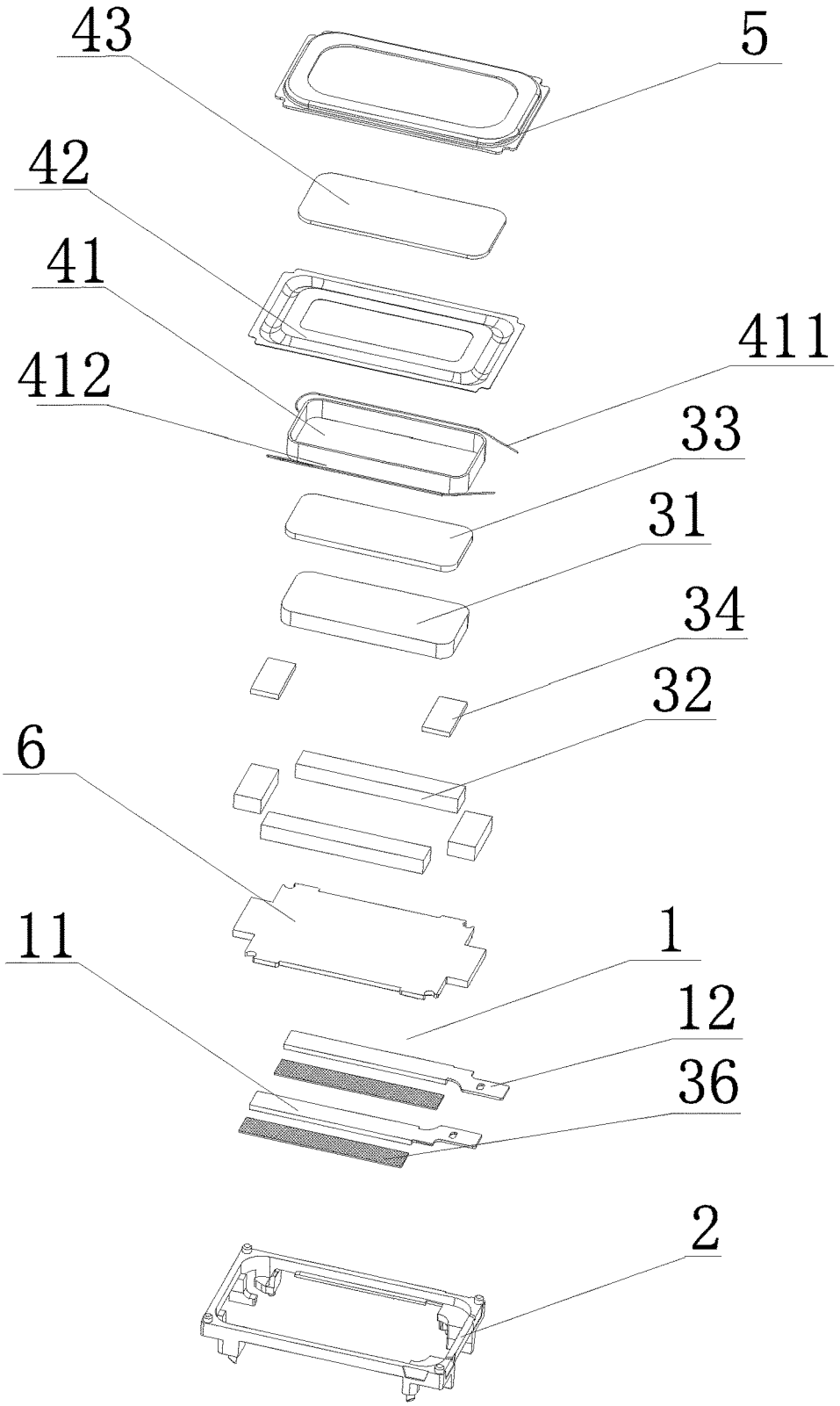
FIG. 3 is an exploded view of a speaker structure provided by a specific embodiment of the present invention.
Figure 4:
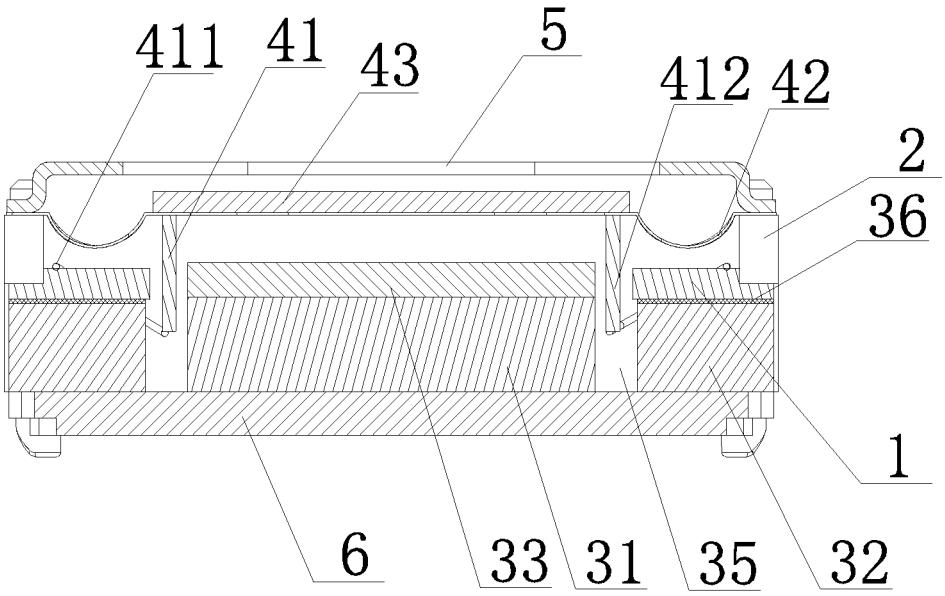
FIG. 4 is a side sectional view of a speaker structure provided by a specific embodiment of the present invention.

In specific embodiments, as shown in FIGS. 3 and 4, the central magnet 31 is mounted in the casing 2, and the peripheral magnets 32 are mounted in locations around the central magnet 31. Certain gaps 35 are left between the peripheral magnets 32 and the central magnet 31, thus forming magnetic gaps. The central washer 33 covers on the central magnet 31 to correct magnetic lines generated by the central magnet 31.

An insulating material 36 is disposed between the washer part 11 and the peripheral magnets 32, and isolates an integral washer conductive sheet 1 from the peripheral magnets 32, to prevent electric current from affecting magnetic induction lines of the peripheral magnets 32 when signals are conducted. The insulating material 36 may be high temperature-resistance insulating adhesive tape or insulating glue.

Figure 5:
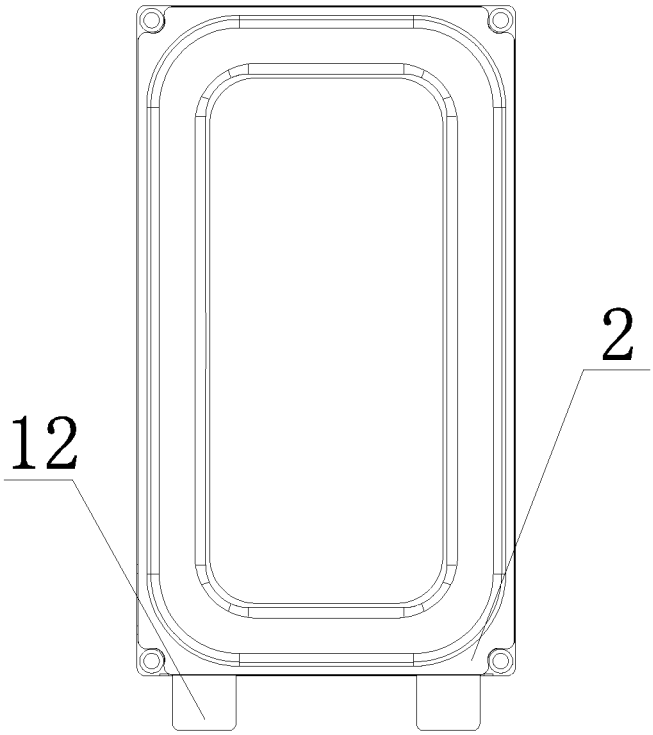
FIG. 5 is a top view of a speaker structure provided by a specific embodiment of the present invention.

The washer part 11 of the integral washer conductive sheet 1 covers on the peripheral magnets 32, the washer part 11 replaces conventional peripheral washers to correct the magnetic lines between the central magnet 31 and the peripheral magnets 32, and the same gap 35 also exists between the washer part 11 and the central washer 33. The conductive sheet part 12 of the integral washer conductive sheet 1 extends outwards from the washer part 11, and extends to the outer part of the casing 2 from the side wall of the casing 2, as shown in FIGS. 2 and 5.

According to requirements of an actual condition, the integral washer conductive sheet 1 may be designed into different shapes, and the washer part 11 covers part of or all the peripheral magnets 32. As shown in FIG. 3, washer part 11 of the integral washer conductive sheet 1 is of a strip structure, and the washer part 11 covers one peripheral magnet 32 at one side of the central magnet 31. The speaker structure comprises two integral washer conductive sheets 1 disposed around the central magnet 31. According to different actual conditions, the two integral washer conductive sheets 1 may be disposed in parallel on the peripheral magnets 32 at both sides of the central magnet 31, or may also be disposed on two adjacent peripheral magnets 32. In addition, peripheral washers 34 may be disposed on the peripheral magnets 32 not covered by the washer part 11, and the peripheral washers may comprise long axis washers and short axis washers, washers with different lengths are disposed on the peripheral magnets 32 of different lengths respectively according to actual conditions.

Particularly, the washer part 11 of the integral washer conductive sheet 1 may be designed into an annular structure, the washer part 11 covers all peripheral magnets 32 around the central magnet 31, and in order to ensure normal conduction of signals, the annular washer part 11 needs to be provided with two conductive sheet parts 12 extending from the washer part 11 towards the outer side of the annular structure and extending out of the casing 2.

The integral washer conductive sheet 1 needs to meet magnetic conductivity of the washer and the conductivity of the conductive sheet simultaneously, and the adopted material is a permeability magnetic material, such as an SPCC material.

Figure 6:
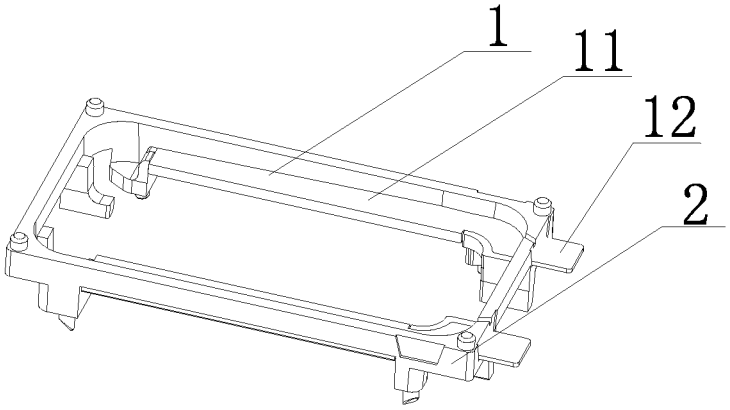
FIG. 6 is a structural schematic diagram of integrally formed integral washer conductive sheet and speaker casing provided by a specific embodiment of the present invention.

Particularly, as shown in FIG. 6, in order to further reduce complexity of an assembling process, the casing 2 and the integral washer conductive sheet 1 may be fixedly coupled into one structure. The conductive sheet part 12 is exposed outside the casing 2, and the washer part 11 is located at the inner side of the casing 2. The casing 2 and the integral washer conductive sheet are molded in one step through injection molding, thus, there is no need to either form a hole in the casing 2 for the conductive sheet to penetrate through, or independently assemble the conductive sheet during assembling.

The vibrating component may comprise a voice coil 41 and a vibrating diaphragm 42, as shown in FIGS. 3 and 4. The edge of the vibrating diaphragm 42 is mounted on the casing 2, and the middle part of the vibrating diaphragm 42 is suspended in the casing 2. The voice coil 41 comprises a lead 411 and a vibrating ring 412, the lead 411 is mounted on the casing 2 and/or the integral washer conductive sheet 1, is electrically connected to the conductive sheet part 12 of the integral washer conductive sheet 1, and is configured to conduct a signal. The lead 411 is connected to the vibrating ring 412 which is suspended in a space inside the casing 2. When an electric signal is conducted to the vibrating ring 412 from the conductive sheet part 12 through the lead 411, the vibrating ring 412 is subjected to the action of Lorentz force to vibrate and drive the vibrating diaphragm 42 to vibrate. In order to enhance a sound quality of the vibrating diaphragm 42, a composite layer Dome 43 is disposed on the vibrating diaphragm 42 to improve the sound quality of the speaker.

In addition, in order to protect the vibrating diaphragm 42, the speaker structure further comprises a front cover 5 which is mounted on the top of the casing 2. The electromagnetic component further comprises a basin frame 6 which is mounted at the bottom of the casing 2 and plays a role in correcting magnetic lines. In different speaker structures, the basin frame 6 may support part of components of the speaker.

The application range of the present invention is not limited to the particular embodiments described above, and those skilled in the art may adjust the features such as a structure and a distribution manner of the washer part, a molding process of the integral washer conductive sheet, etc. The principle of the present invention is as below: the washer and conductive sheet structure in the speaker structure are integrally molded to reduce complexity of the speaker parts and simplify assembling procedures. Those skilled in the art may make various changes, modifications, replacements and transformations on these embodiments without departing from the principle and spirit of the present invention, and claims appended to the present invention aim to contain these transformations and replacements within their protection scopes.

What is claimed is:

1. A speaker structure, comprising:

a vibrating component;

an electromagnetic component, comprising a central magnet and peripheral magnets disposed around the central magnet;

a casing bearing speaker parts;

an integral washer conductive sheet, comprising a washer part for correcting magnetic lines and a conductive sheet part for conducting a signal, wherein the washer part and the conductive sheet part are integrally formed, the washer part is disposed on the peripheral magnets and the conductive sheet part extends out of the casing; and an insulating material, disposed between the integral washer conductive sheet and the peripheral magnets.

2. The speaker structure according to claim 1, wherein the washer part covers part of the peripheral magnets, and the peripheral magnets not covered by the washer part are covered by peripheral washers.

3. The speaker structure according to claim 2, wherein the peripheral washers comprise long axis washers and short axis washers, which are respectively disposed on the peripheral magnets of different lengths.

4. The speaker structure according to claim 2, wherein the washer part is of a strip structure, and the speaker structure comprises two integral washer conductive sheets disposed on the peripheral magnets.

5. The speaker structure according to claim 1, wherein the washer part is an annular washer part covering all the peripheral magnets, and the integral washer conductive sheet comprises two conductive sheet parts which extend outwards from the washer part.

6. The speaker structure according to claim 1, wherein the integral washer conductive sheet is fixedly coupled with the casing.

7. The speaker structure according to claim 1, wherein the speaker structure comprises a central washer disposed on the central magnet.

8. The speaker structure according to claim 1, wherein the vibrating component comprises:

a vibrating diaphragm mounted on the casing; and a voice coil suspended on the casing, the voice coil comprising a lead and a vibrating ring, wherein the lead is electrically connected to the conductive sheet part, and the voice coil drives the vibrating diaphragm to vibrate.

9. The speaker structure according to claim 8, wherein a composite layer dome is disposed on the vibrating diaphragm.

10. The speaker structure according to claim 1, wherein the electromagnetic component comprises a basin frame mounted at a bottom of the casing.

* * * * *